US006252484B1

(12) United States Patent
Maeda

(10) Patent No.: US 6,252,484 B1
(45) Date of Patent: Jun. 26, 2001

(54) TRANSFORMER

(75) Inventor: Osamu Maeda, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 09/112,266

(22) Filed: Jul. 8, 1998

(30) Foreign Application Priority Data

Jul. 9, 1997 (JP) ..... 9-005970

(51) Int. Cl.[7] ..... H01F 27/29; H01F 27/30
(52) U.S. Cl. ..... 336/192; 336/208; 336/198
(58) Field of Search ..... 336/198, 192, 336/208, 178

(56) References Cited

U.S. PATENT DOCUMENTS

| | | | | |
|---|---|---|---|---|
| 3,760,339 | * | 9/1973 | Marshall | 336/221 |
| 3,792,398 | * | 2/1974 | Norlin et al. | 336/192 |
| 3,939,450 | * | 2/1976 | Donnelly | 336/192 |
| 4,047,138 | * | 9/1977 | Steigerwald | 336/178 |
| 5,200,731 | * | 4/1993 | Tochio et al. | 336/192 |
| 5,281,942 | * | 1/1994 | Stokes | 336/192 |
| 5,315,280 | * | 5/1994 | Stokes et al. | 336/192 |
| 5,570,075 | * | 10/1996 | Krimmer et al. | 336/96 |

FOREIGN PATENT DOCUMENTS

| | | | |
|---|---|---|---|
| 36-24294 | | 2/1960 | (JP) . |
| 2-35423 | | 3/1990 | (JP) . |
| 2-60208 | | 5/1990 | (JP) . |
| 4-56303 | | 5/1992 | (JP) . |
| 7-86054 | | 3/1995 | (JP) . |
| 40 90 97728A | * | 4/1997 | (JP) ..... 336/208 |

* cited by examiner

*Primary Examiner*—Anh Mai
(74) *Attorney, Agent, or Firm*—Lackenbach Siegel Marzullo Aronson & Greenspan

(57) ABSTRACT

A transformer arranged to be mounted on a subject, such as a printed circuit board or the like, such that the central axis of a winding thereof is positioned horizontally. The transformer includes a bobbin portion having flange portions which are formed perpendicular to the central axis and which have terminal portions disposed on the lower end portion thereof, wherein the terminal portions are connection terminal portions to the subject. That is, leading ends of the windings are connected to the nearest terminal portions for short distances.

16 Claims, 10 Drawing Sheets

TRANSFORMER

BACKGROUND OF THE INVENTION

1. Field of the Invention

The present invention relates to a transformer, and more particularly to a split-winding pulse transformer.

2. Description of the Related Art

A conventional split-winding pulse transformer from which a variety of outputs for use in a video taper recorder can be obtained will now be described with reference to FIGS. 9(A) and 9(B).

FIG. 9(A) is a front view showing a conventional split-winding pulse transformer and FIG. 9(B) is a rear view of the same.

The conventional split-winding pulse transformer includes a core portion 10 disposed vertically, a terminal frame 20 for holding the lower portion of the core portion 10, a plurality of primary-terminal portions 30 and a plurality of secondary-terminal portions 31 provided below the terminal frame 20 in a dual in-line configuration, a bobbin portion 11 received by a core member of the core portion 10, and a base winding 12, primary windings 13 and 15 and secondary windings 14 wound around the bobbin portion 11.

In order to generate a plurality of voltage levels (four voltage levels in FIGS. 9(A) and 9(B)) required in a video tape recorder, the conventional split-winding pulse transformer has a structure in which four types of secondary windings 14 are wound around the bobbin portion 11 in a stacked manner. The four types of secondary windings 14 are wired to reach the secondary-terminal portions 31 across the primary winding 13, the base winding 12 and the terminal frame 20 which are disposed below the secondary windings 14.

The base winding 12 is wired to reach the primary-terminal portions 30 across the terminal frame 20.

The primary winding 13 is wired to reach the primary-terminal portions 30 across the base winding 12 and the terminal frame 20.

The other primary winding 15 is wired to reach the primary-terminal portions 30 across the secondary windings 14, the base winding 12, the primary winding 13 and the terminal frame 20.

However, the conventional split-winding pulse transformer requires wiring from each winding to predetermined terminal portions 30 (or 31) across the other windings and the terminal frame 20. Therefore, the wiring after winding and arrangement of the wires are too complicated to realize satisfactory workability. What is worse, design of the wiring requires a long time and excess wiring must be performed. In addition, there is apprehension that the wire is damaged when the wiring operation is performed.

On the other hand, a transformer has been disclosed in Japanese Utility Model Examined Publication No. Sho. 36-24294, the transformer being arranged in a manner that the central axes of windings are positioned horizontally with respect to a printed circuit board. The transformer has a plurality of projecting terminal portions each of which is formed at the lower end portion of two side walls of a bobbin around which the windings are wound. Moreover, the leading ends of the windings are connected to the terminal portions. Mounting of the transformer on the printed circuit board is performed by inserting the terminal portions into cut holes formed in the printed circuit board and by dipping it into a soldering dip vat.

Although such a transformer may be able to overcome the above-described problems, it is not a split-winding transformer. Moreover, strength for mounting the transformer on the printed circuit board is unsatisfactory.

SUMMARY OF THE INVENTION

An object of the present invention is to provide a split-winding transformer having a structure with which the productivity can be improved and the cost can be reduced and which can strongly be mounted on a mounting subject, such as a printed circuit board.

In order to achieve the above object, the present invention provides a transformer arranged to be mounted on a subject, such that a central axis of a winding thereof is positioned horizontally, the transformer comprising: a bobbin portion having three or more flange portions which are formed perpendicular to the central axis and each of which has terminal, portion provided with a projection, integrally extended from a lower end portion thereof; and two or more windings, each having leading ends wound around the bobbin portion across one of the flange portions, wherein the terminal portions are connection terminal portions with a substrate on which the transformer is mounted.

BRIEF DESCRIPTION OF THE DRAWINGS

FIGS. 7(A) to 7(C) are perspective views each showing a terminal portion provided in the lower portion of the flange portion, in which FIG. 7(A) shows a terminal portion according to the embodiment, and FIGS. 7(B) and 7(C) show terminal portions according to other embodiments.

DETAILED DESCRIPTION OF THE PREFERRED EMBODIMENTS

A split-winding pulse transformer which is an embodiment of a transformer according to the present invention will now be described as a representative example with reference to FIGS. 1 to 8(D). In this embodiment, the transformer generates four voltage levels for use in a video tape recorder.

Figure 1:
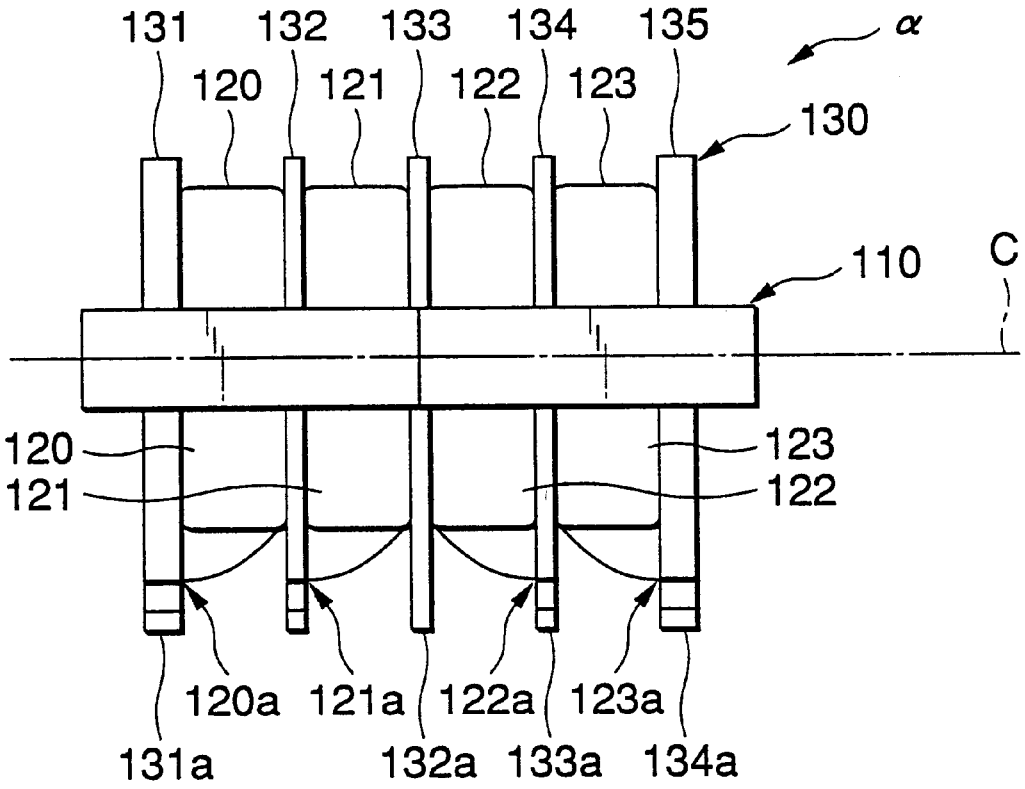
FIG. 1 is a front view showing an embodiment of a transformer according to the present invention.

As shown in FIG. 1, a transformer a according to the embodiment includes a core portion 110 disposed horizontally, a bobbin portion 130 inserted into the core portion 110, a base winding 120, two primary windings 121 and 123, and four types of stacked secondary windings 122. These windings are wound around the bobbin portion 130 respectively.

Figure 2:
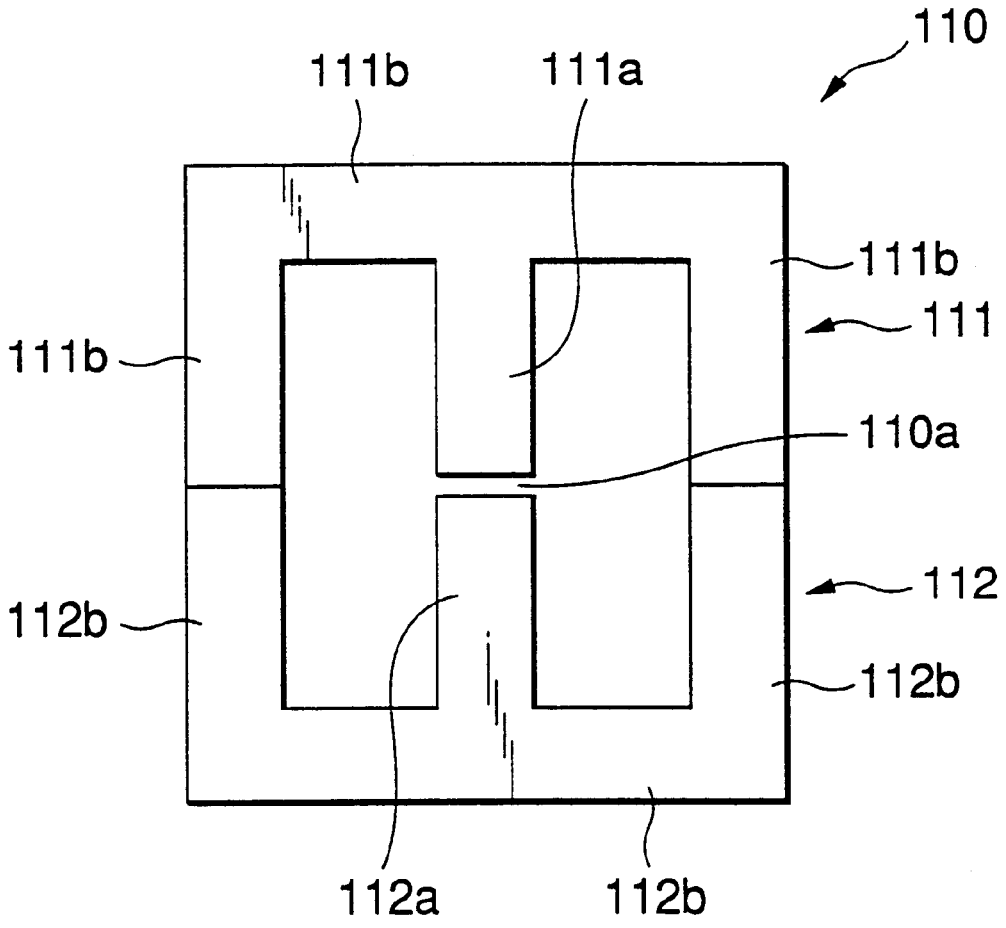
FIG. 2 is a plan view showing a core portion of the embodiment of the transformer according to the present invention.

As shown in FIG. 2, the core portion 110 has a so-called E-E type core constituted by, for example, two substantially E-like cores 111 and 112 which are disposed opposite to each other.

The core portion 110 includes outer peripheries 111*b* and 112*b* disposed in the outer periphery portions of the E-like structure, bobbin support portions 111*a* and 112*a* disposed at a central lateral rod of the E-like structure so as to support the bobbin portion 130, and a gap portion 110*a* disposed between the bobbin support portions 111*a* and 112*a*.

Here, it is noted that the vertical cross section of the core portion 110 is formed into a rectangular shape.

Figure 3:
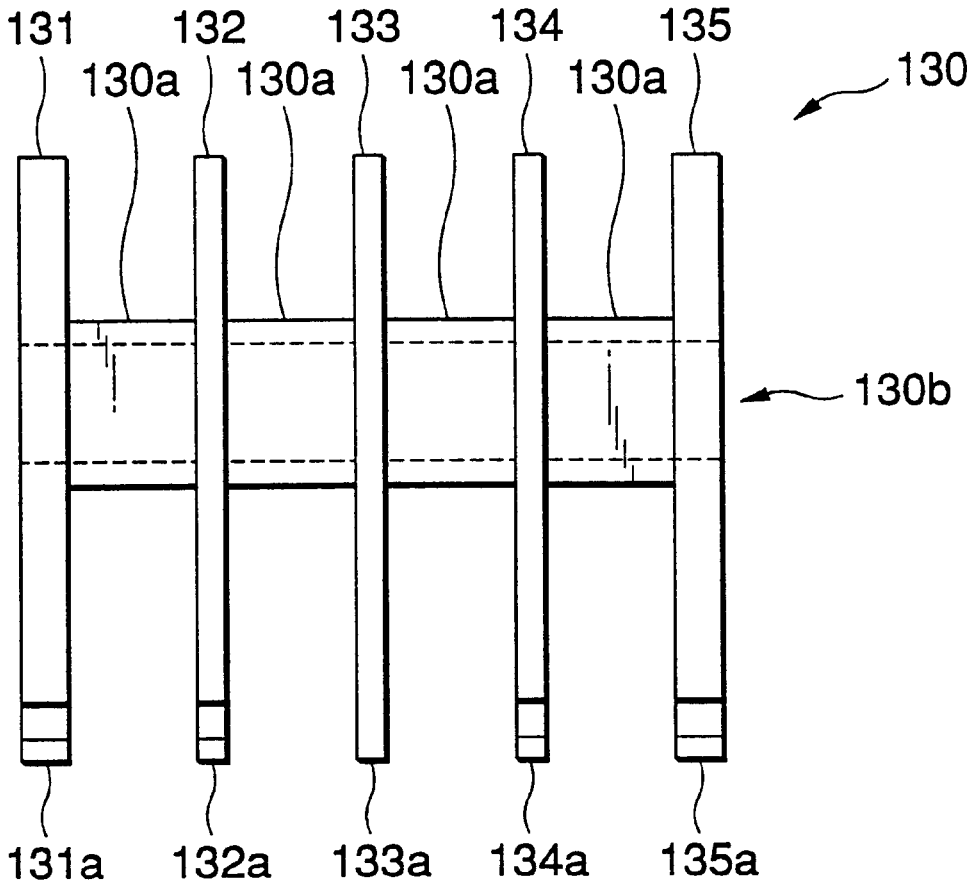
FIG. 3 is a front view showing a bobbing portion of the embodiment of the transformer according to the present invention.

As shown in FIG. 3, the bobbin portion 130 includes a rectangular pipe portion 130*a*, and flange portions 131, 132, 133, 134 and 135 disposed around the rectangular pipe portion 130*a* at the same intervals and perpendicular to a central axis C common to four windings, that is, the base winding 120, the primary windings 121 and 123, and the secondary windings 122.

Figure 4:
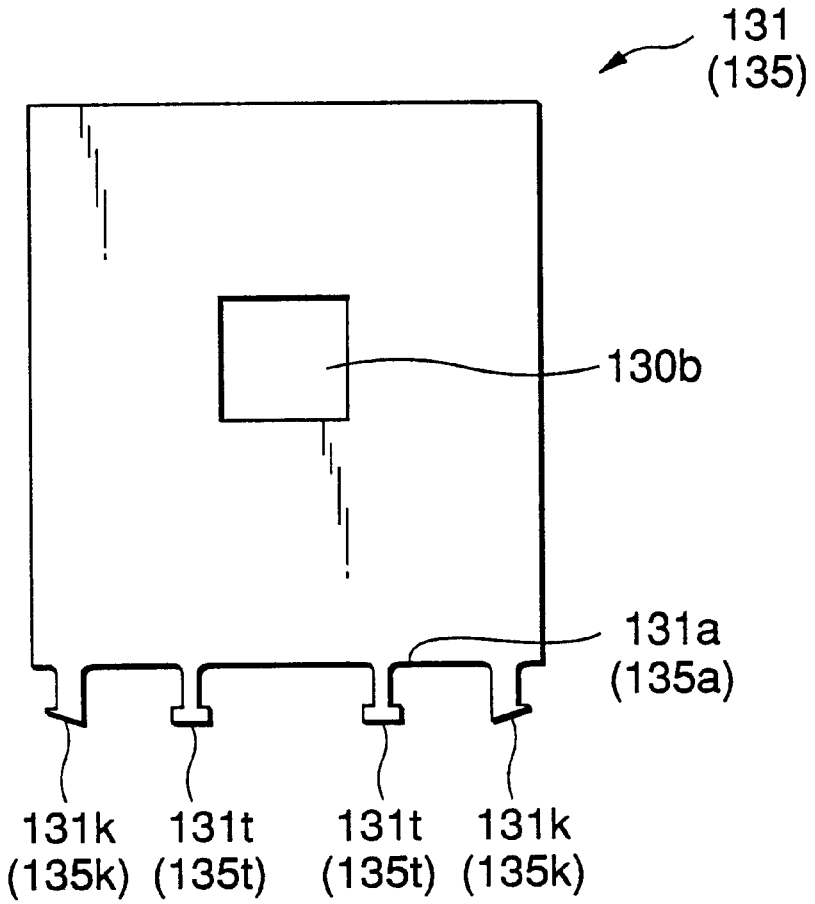
FIG. 4 is a side view showing flange portions formed on both outer ends of the bobbin portion of the embodiment of the transformer according to the present invention.
Figure 5:
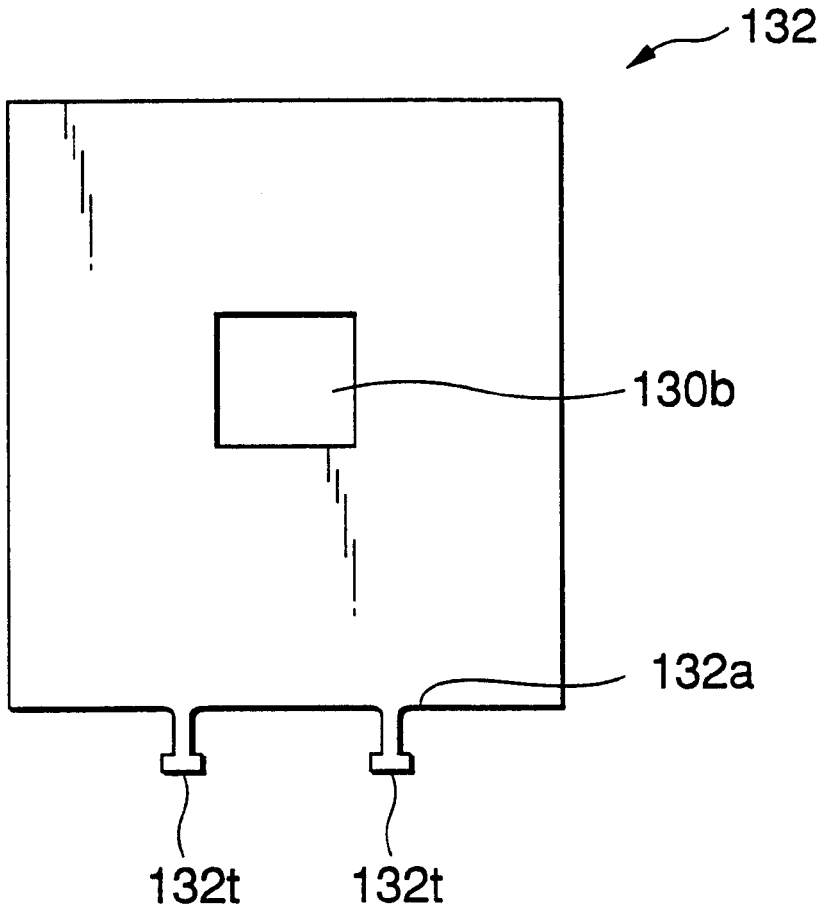
FIG. 5 is a side view showing a flange portion of the bobbin portion of the embodiment of the transformer according to the present invention to which a primary winding is connected.
Figure 6:
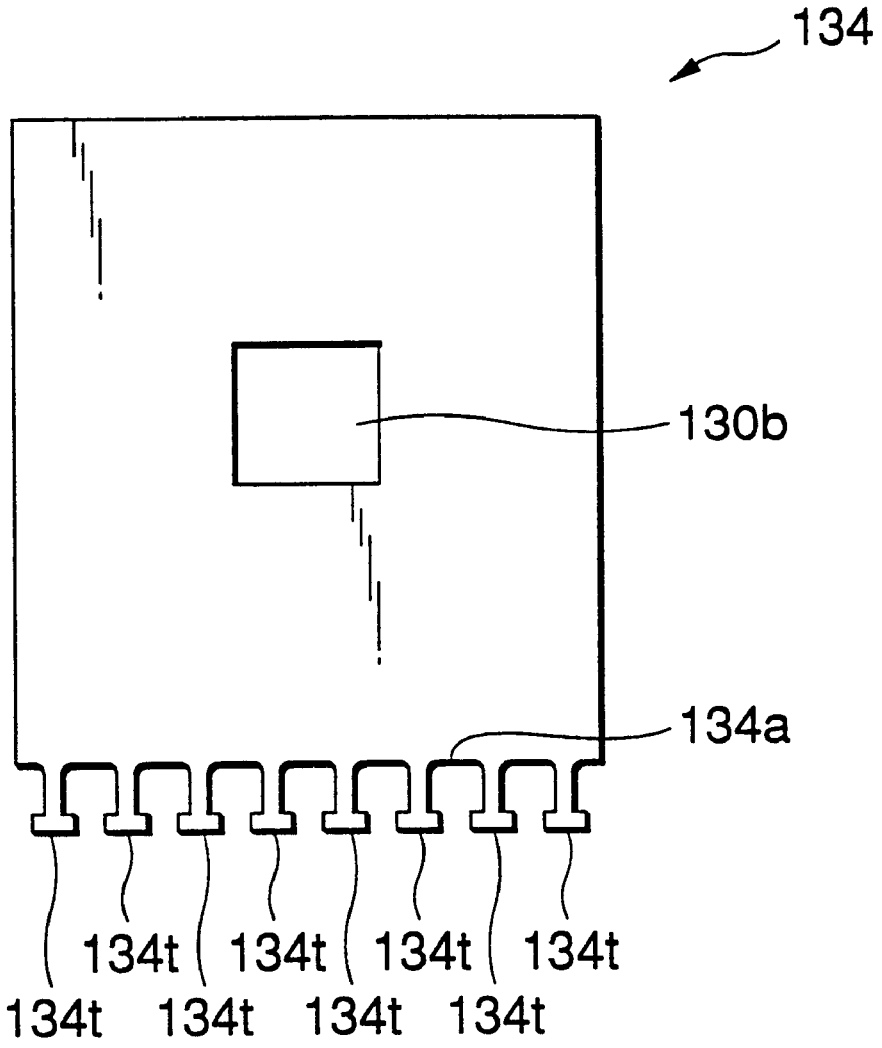
FIG. 6 is a side view showing a flange portion of the bobbin portion of the embodiment of the transformer according to the present invention to which a secondary winding is connected.

An opening portion 130*b* of the rectangular pipe portion 130*a* is a portion into which the bobbin support portions 111*a* and 112*a* of the core portion 110 are hermetically inserted. Each of the flange portions 131, 132, 133, 134 and 135 is made of a substantially rectangular plate, as shown in FIGS. 4 to 6. The thickness of the flange portions 131 and 135 disposed at the both ends of the bobbin portion 130 is larger than that of the flange portions 132, 133 and 134 disposed between the flange portions 131 and 135. The reason for this lies in that when the thickness of each of the flange portions 131 and 135 is larger, a satisfactory effect can be obtained to strengthen engaging portions 131*k* and 135*k* which will be described later and provided for the flange portions 131 and 135. Moreover, strength is required to support the core portion 110 and the like.

As shown in FIG. 4, the flange portion 131 has a lower end portion 131*a* on which two terminal portions 131*t* and two engaging portions 131*k* are formed.

Each of the terminal portions 131*t* is formed into a substantially inverted T-shape which is a shape "having a projection and a branched portion branched from a portion of the projection" (the terminal portions 132*t*, 134*t* and 135*t* have the same shape).

The terminal portions 131*t* are terminals to which both leading ends 120*a* of the base winding 120 are connected (See FIG. 1. Only one leading end 120*a* on this side is shown. The other leading end 120*a* is disposed on the deeper side when it is viewed in FIG. 1. This is applied also to the other windings). Each of the engaging portions 131*k* is formed into a shape having a claw projecting laterally from the side surface of the projection on the leading end side thereof.

The engaging portions 131*k* are portions which are engaged with engaging through-holes formed in a printed circuit board (FIG. 10) to which the transformer a is secured.

As shown in FIG. 5, the flange portion 132 has a lower end portion 132*a* on which two terminal portions 132*t* are formed each of which has a substantially inverted T-shape.

The terminal portions 132*t* are terminals to which both leading ends 121*a* (see FIG. 1) of the primary winding 121 are connected.

As shown in FIG. 1, the flange portion 133 has a lower end portion 133*a* on which no terminal portions are formed. Only a plate-like portion is extended.

The lower end portion 133*a* is inserted into a securing elongate opening of the printed circuit board (not shown) to which the transformer a is secured, so that the transformer a is secured.

As shown in FIG. 6, the flange portion 134 has a lower end portion 134*a* on which eight terminal portions 134*t* in the form of a substantially inverted T-shape are formed.

The terminal portions 134*t* are terminals to which both leading ends 122*a* (see FIG. 1) of each of the four stacked secondary windings 122 are connected.

As shown in FIG. 4, the flange portion 135 is formed similarly to the flange portion 131. That is, two terminal portions 135*t* in the form of a substantially inverted T-shape and two engaging portions 135*k* are formed on a lower end portion 135*a* of the flange portion 135.

The terminal portions 135*t* are terminals to which both leading ends 123*a* (see FIG. 1) of the other primary winding 123 are connected.

The engaging portions 135*k* are portions which are engaged with engaging through-holes of the printed circuit board (not shown) to which the transformer a is secured.

The transformer a including the bobbin portion 130 and the core portion 110 structured as described above is assembled as follows:

Initially, the base winding 120, the primary winding 121, the four types of the secondary windings 122 which will be stacked and the primary winding 123 are, in this sequential order, wound around the rectangular pipe portion 130*a* (see FIG. 3) of the bobbin portion 130 each by a predetermined number of turns as shown in FIG. 2, the winding portion being started from the left-hand end. This winding operation is performed by a means (not shown), such as a winding machine.

Figure 7A:
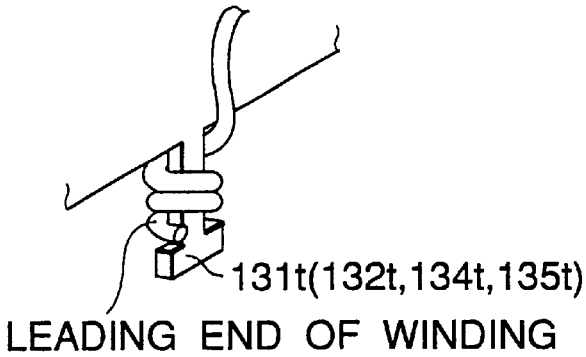

Then, both leading ends 120*a* and so forth of the wound base winding 120, primary winding 121, four types of the secondary windings 122 and the primary winding 123 are wound around predetermined near terminal portions 131*t* and so forth as shown in FIG. 7(A) so that the leading ends are temporarily secured.

Then, the leading ends 120*a* and so forth of the windings are connected to the terminal portions 131*t* and so forth by the shortest possible lengths to associated terminal portions and are allowed to pass through a soldering dip vat so as to be soldered.

Here, the creep distance for insulation between the primary winding and the secondary winding must be, for example, 3.5 mm or longer to satisfy a standard. In the transformer a, the creep distance for insulation between the primary winding 121 and the secondary windings 122 can easily and reliably be maintained by the flange portion 133. Also, the creep distance for insulation between the primary winding 123 and the secondary windings 122 can easily and reliably be maintained by the flange portion 134.

Then, the cores 111 and 112 are inserted into both ends of the opening portion 130*b* of the rectangular pipe portion 130*a* of the bobbin portion 130. At this time, the contact portion between the core 111 and the core 112 is welded (brazed) so as to be secured.

Thus, the transformer $\alpha$ is manufactured.

The transformer a is, as described below, connected and secured to a printed circuit board (FIG. 10) which is the subject to which the transformer a is connected and secured. The printed circuit board includes plating through-holes for the terminal portions 131*t*, 132*t*, 134*t* and 135*t*, engaging through-holes for the engaging portions 131*k* and 135*k* and securing elongated opening for the lower end portion 133*a* of the flange portion 133. The terminal portions 131*t*, 132*t*, 134*t* and 135*t*, the engaging portions 131*k* and 135*k*, and the lower end portion 133*a* of the flange portion 133 are inserted into the corresponding through-holes, engaging through-holes, and securing elongated opening. The engaging portions 131*k* and 135*k* are engaged with the engaging through-holes. The lower end portion 133*a* of the flange portion 133 is secured to the securing elongated opening. Moreover, the terminal portions 131*t*, 132*t*, 134*t* and 135*t* are connected and secured to the plating through-holes by a connecting and securing means, such as soldering. As described above, the transformer a is provided with the engaging portions 131*k* and 135*k*. Moreover, the thickness of each of the flange portions 131 and 135 is larger than that of each of the flange portions 132, 133 and 134. Therefore, the transformer a can reliably and strongly be mounted on the printed circuit board.

As a matter of course, the core portion 110 may be formed into an E-I shape or the like in place of the E-E shape. The present invention may, of course, be applied to a usual transformer which is not provided with the gap 110*a*.

Figure 7B:
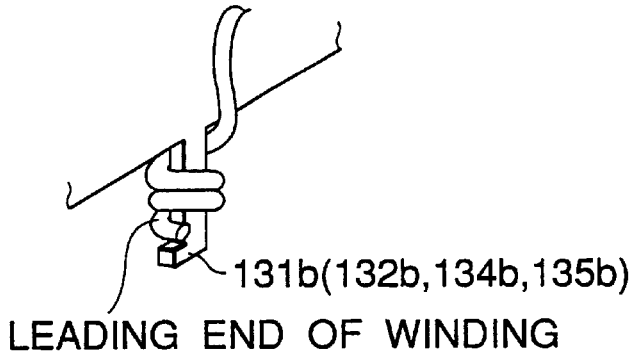
Figure 7C:
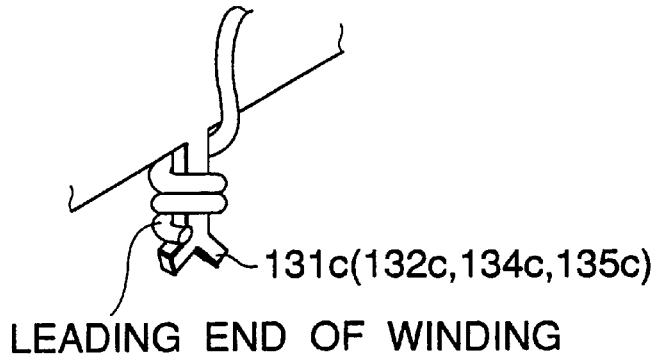

The terminal portion 131*t* and so forth may be formed, for example, as shown in FIGS. 7(B) and 7(C). That is, the terminal portion 131*t* and so forth may be formed into a substantially L-like shape as a terminal portion 131*b* or the like shown in FIG. 7(B) or a substantially inverted Y-shape as a terminal portion 131*c* or the like shown in FIG. 7(C).

If one of the above-described shapes is employed, the winding wound around the terminal portion is not slipped during the temporary securing process.

Figure 8A:
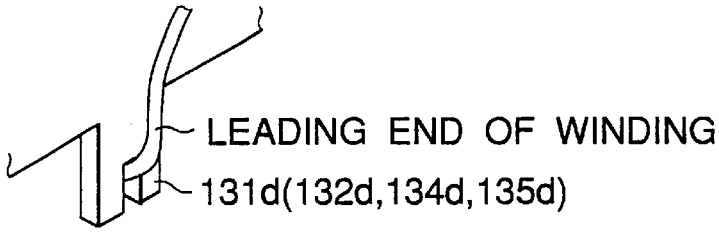
FIGS. 8(A) to 8(D) are perspective views showing terminal portions provided for the lower portion of the flange portion according to other embodiments.
Figure 8B:
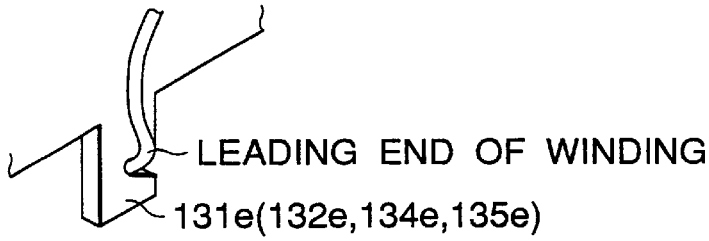

Moreover, the terminal portion 131*t* and so forth may be formed, for example, as shown in FIGS. 8(A) and 8(B). That is, the terminal portion 131*t* and so forth may be formed into a substantially inverted U-shape as a terminal portion 131*d* or the like shown in FIG. 8(A), or a substantially U-shape facing side as a terminal portion 131*e* or the like shown in FIG. 8(B), as a shape "having a projection and a cut portion formed by cutting a portion of the projection". It is noted that the cut portion of each of the recessed portions is formed such that the width is reduced toward the back so as to reliably hold the leading end of the winding. Therefore, the leading end 120*a* and so forth of the windings can easily and temporarily be secured in the substantially inverted U-shape recessed portion. Then, the leading end 120*a* and so forth of the windings connected as described above are allowed to pass through the soldering dip vat so as to be soldered.

Figure 8C:
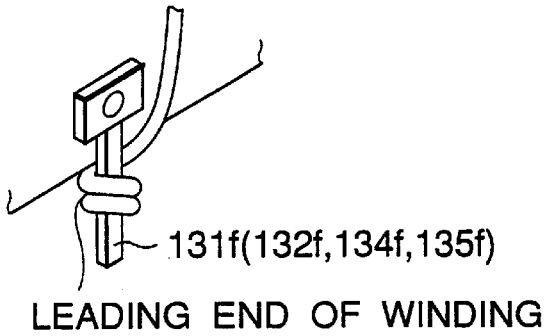

As a terminal portion 131*f* or the like shown in FIG. 8(C), a terminal portion may be formed such that a terminal which is a substantially T-shape metal member is joined to the lower end portion of the flange portion 131 or the like of the bobbin portion 130.

Figure 8D:
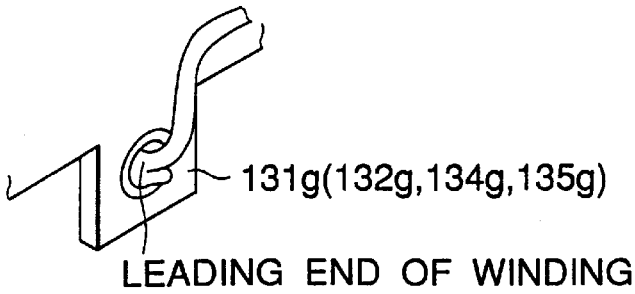
Figure 9A:
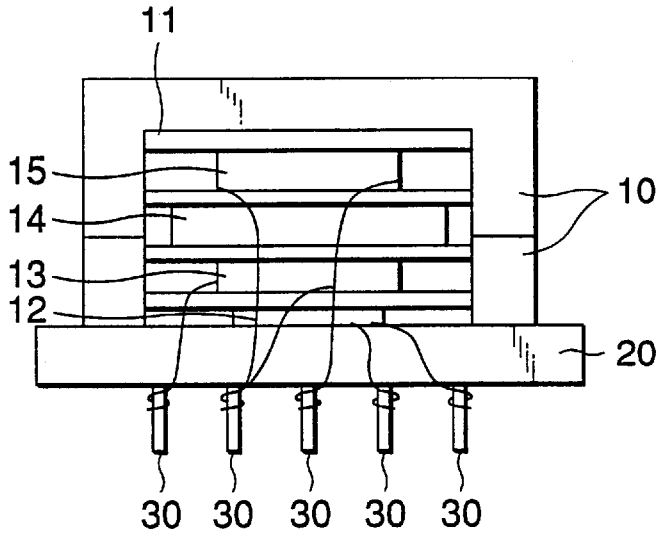
FIG.9(A) PRIOR ART
FIG. 9(A) is a front view of a conventional split-winding pulse transformer and FIG. 9(B) is a rear view of the same.
Figure 9B:
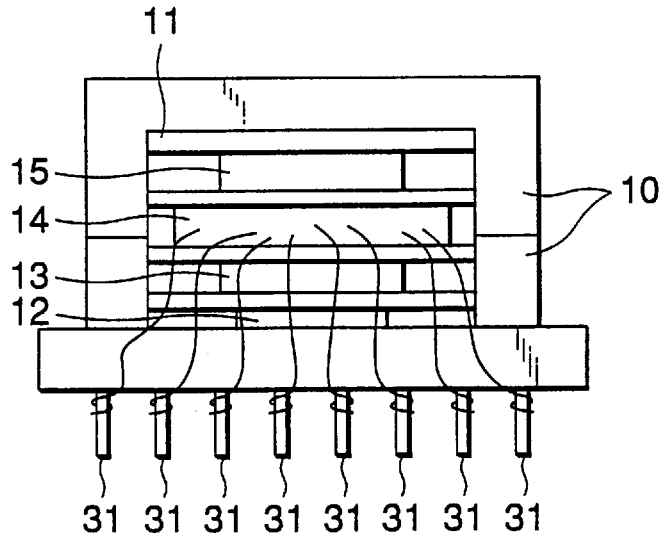
FIG.9(B) PRIOR ART

Moreover, as a terminal portion 131*g* or the like shown in FIG. 8(D), a terminal portion may be formed such that a projection is formed on the lower end portion of the flange portion 131 or the like and an eyelet metal ring is fitted to the projection.

The above-described shapes may be combined with each other to form the terminal portion.

Although the bobbin portion 130 is integrally molded from a material, such as synthetic resin, having an insulating characteristic and some flexibility, the bobbin portion 130 may be separately-molded.

The number and the shape of the engaging portions 131*k* and 135*k* of the bobbin portion 130 are not limited to those in the above-described embodiment. For example, the engaging claws may face right and left in the case shown in FIG. 1. Further, the engaging portions may be molded individually from the bobbin portion 130 so as to be joined to the bobbin portion 130 and/or the core portion 110 to serve as the engaging portions. If the dead weight of the transformer a is light, the engaging portions 131*k* and 135*k* may be omitted.

The flange portion 131 and so forth may be formed into a substantially ellipse-like shape in place of the substantially rectangular shape. In this case, a required number of the terminal portions as shown in FIGS. 7(A) to 7(C) may be provided.

As a matter of course, the flange portion 131 and so forth are not required to be provided for the bobbin portion 130 at the same intervals.

Figure 10:
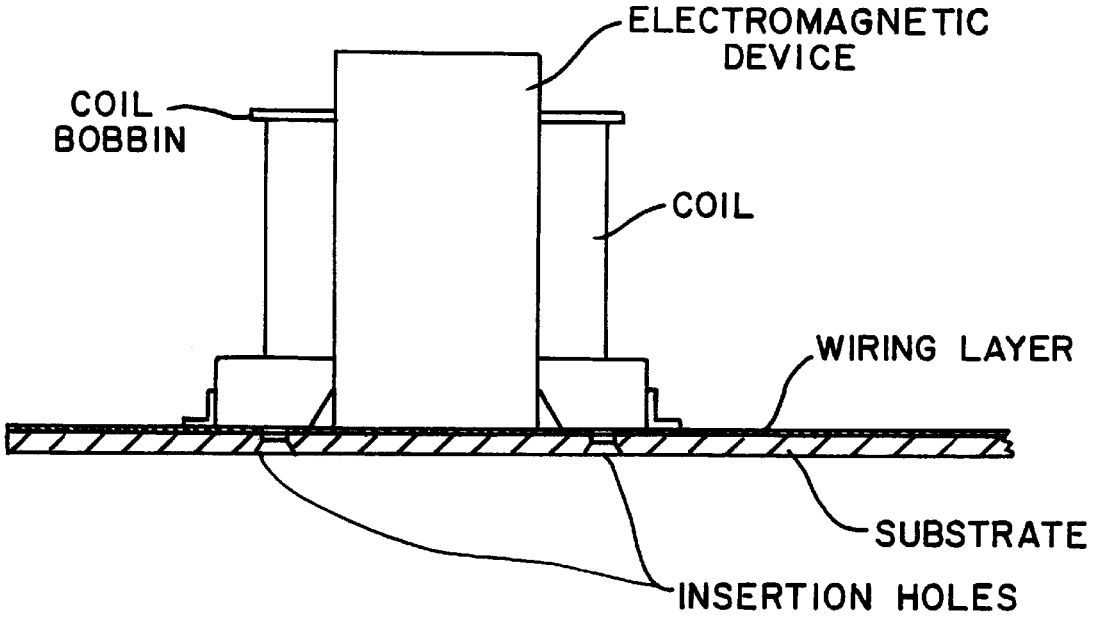
FIG. 10 is a drawing, partly in section, showing the substrate/PCB (printed circuit board) upon which the transformer(s) of the invention are mounted, and also showing the through holes or apertures formed in the substrate for the projection(s) integrally extending from the lower end portion of the flange portions of the bobbin.

FIG. 10 shows a view, partly in section. of a PCB through substrate with holes or apertures therein, adapted to accommodate their projections extending integrally from the lower end portion of the flange portions of the bobbin.

As the transformer a according to the present invention, a split-winding pulse transformer which generates four output voltage levels for use in a video tape recorder has been described as a representative structure. It is apparent that the above-described structure can be also applied in which the terminal portions and engaging portions are provided for the flange portions, to another general split-winding transformer. Therefore, description of this case is omitted.

As described above, the transformer according to the present invention is a transformer arranged to be mounted on a subject, such as a printed circuit board or the like, such that the central axis of a winding thereof is positioned horizontally, the transformer comprising: a bobbin portion having three or more flange portions which are formed perpendicular to the central axis and each of which has terminal portions, provided with projections, integrally extended from the lower end portion thereof; and two or more windings, each having leading ends, wound around the bobbin portion across one of the flange portions, wherein the terminal portions are connection terminal portions for establishing the connection with the subject.

Therefore, a plurality of windings can be, for shortest distances, connected to the terminal portions disposed on the lower end portion of the nearest flange portions.

Thus, excessive wiring and arrangement of wires can be omitted. Therefore, the wiring operation and the design of the wiring can easily be performed. Moreover, the wires are not damaged during the wiring operation and required wiring materials can be reduced. In addition, the metal terminals required for the conventional structure can be omitted, and the process for press-fitting the metal terminals can be omitted. As a result, the manufacturing cost can be reduced. The terminal portions of the flange portions at the both side ends of the bobbin and the terminal portions of the flange portion formed between the former flange portions, in cooperation with each other, enable the transformer to strongly be joined to the subject, such as a printed circuit board.

It is preferable that the transformer according to the present invention may have the structure that the terminal portion has a projection and a branched portion branched from a portion of the projection.

In this case, the leading end of the winding is wound around the projection of the terminal portion which is not the branched portion so that the leading end of the winding is temporarily secured to the terminal portion. At this time, the branched portion prevents undesirable slip of the leading end of the winding. Thus, the leading end of the winding can reliably and temporarily be secured.

Then, the wire wound around the terminal portion is soldered in a soldering dip vat or the like in the finishing process for the transformer. Therefore, the leading end of the winding can reliably be secured to the terminal portion to serve as a terminal. As a result, significant reliability can be realized as a terminal.

The transformer according to the present invention may have the structure that the terminal portion has a projection and a cut portion formed by cutting a portion of the projection.

In this case, when the leading end of the winding is temporarily secured to the terminal portion, the temporal securing can easily be performed by simply engaging the leading end of the winding to the cut portion.

Then, the wire engaged to the terminal portion is soldered in a soldering dip vat or the like in the finishing process for the transformer. Thus, the terminal portion can easily be formed and the manufacturing cost can be reduced.

The transformer according to the present invention may have the structure that an engaging portion is formed at the lower end portion of each of the flange portions at the both side ends of the bobbin portion. Moreover, the thickness of each of the flange portions formed at the both side ends of the bobbin portion may be larger than those of the other flange portions.

In this case, a transformer having a heavy dead weight can reliably and easily be secured to the subject, such as a printed circuit board, thanks to the engaging portion.

What is claimed is:

1. A split-winding pulse transformer for mounting on a substrate, such as a printed circuit board, such that a central axis of a winding thereof is positioned horizontally, said transformer comprising:

a bobbin portion having three or more flange portions which are formed perpendicular to the central axis and each of which has terminal portions integrally formed with said flange portions, provided with projection(s), integrally extended from a lower end portion thereof; and two or more windings, each having leading ends wound around said bobbin portion, said two or more windings each being connected to associated terminal portions by means of shortest possible lengths due to their connection to associated the terminal portions disposed on the lower end portions of flange portions closest to said bobbin portions, wherein said terminal portions are connection terminal portions with said substrate when said transformer mounted on said substrates, whereby manufacturing productivity of said split-winding pulse transformer is improved and its production cost reduced: as excessive wiring and arrangement of wires are eliminated since said windings do not cross any other windings.

2. The transformer according to claim 1, wherein said two or more windings wound around said bobbin portion include a primary winding and a secondary winding wound across one flange portion, with creep distance for insulation between the primary winding and the secondary winding is maintained by said one flange portion.

3. The transformer according to claim 1, wherein each of said terminal portions has a projection and a branched portion formed by branching a portion of the projection.

4. The transformer according to claim 1, wherein each of said terminal portions has a projection and a cut portion formed by cutting a portion of the projection.

5. The transformer according to claim 1, wherein an engaging portion is provided for a lower end portion of each of the flange portions at both side ends of said bobbin portion.

6. The transformer according to claim 5, wherein each of the flange portions at the both side ends of said bobbin portion has a thickness larger than that of each of the other flange portions.

7. The transformer according to claim 1, wherein a core portion which is inserted into said bobbin portion is an E-E type core disposed horizontally in a direction of the central axis of the winding.

8. The transformer according to claim 7, wherein said E-E type core includes two cores each having a substantially E-like shape, and a gap portion is formed between central lateral rod portions of the cores.

9. The transformer according to claim 1, wherein a core portion which is inserted into said bobbin portion is an E-I type core disposed horizontally in a direction of the central axis of the winding.

10. A transformer assembly comprising the transformer according to claim 1, and said substrate on which the transformer is mounted, wherein each of said terminal portions is inserted into an engaging through-hole formed in said substrate and a leading end of each of said terminal portions is dipped in solder.

11. A split-winding pulse transformer for mounting on a substrate, such as a printed circuit board (PCB), such that a central axis of a winding thereof is positioned horizontally, said transformer comprising:

a bobbin portion having three or more flange portions which are formed perpendicular to the central axis and each of which has terminal portions provided with projection(s), integrally extended from a lower end portion thereof, at least one of said flange portions being formed with engaging portions dimensioned to be received through and retained within holes in the substrate; and two or more windings, each having leading ends wound around said bobbin portion, wherein said terminal portions are connection terminal portions with the substrate when said transformer is mounted on said substrate, and said engaging portions secure the transformer to the substrate, whereby manufacturing productivity of said split-winding pulse transformer is improved and its production cost reduced as excessive wiring and arrangement of wires are eliminated.

12. A split-winding pulse transformer as defined in claim 11, wherein said engaging portions are in the form of a hook-shaped claw.

13. A split-winding pulse transformer as defined in claim 11, wherein engaging portions are provided on at least two flange portions.

14. A split-winding pulse transformer as defined in claim 13, wherein two flange portions are arranged at the axial ends of the transformer, and said engaging portions are provided on said two flange portions.

15. A split-winding pulse transformer as defined in claim 11, wherein said flange portions include thinner and thicker flange portions, and said engaging portions are provided on said thicker portions.

16. A split-winding pulse transformer as defined in claim 11, wherein said engaging portions are integrally formed with said flange portions.

* * * * *